United States Patent [19]

Komura et al.

[11] 4,252,883

[45] Feb. 24, 1981

[54] PROCESS FOR PRODUCING ELECTROPHOTOGRAPHIC PHOTOSENSITIVE MEMBER

[75] Inventors: Noboru Komura, Tokyo; Hirokazu Negishi; Katsumobu Ohara, both of Kawasaki; Yoshitaka Ohori, Yokohama, all of Japan

[73] Assignee: Canon Kabushiki Kaisha, Tokyo, Japan

[21] Appl. No.: 121,275

[22] Filed: Feb. 13, 1980

Related U.S. Application Data

[63] Continuation of Ser. No. 666,780, Mar. 15, 1976, abandoned, which is a continuation of Ser. No. 354,509, Apr. 25, 1973, abandoned.

[30] Foreign Application Priority Data

Apr. 28, 1972 [JP] Japan ..... 47/42995

[51] Int. Cl.[3] ..... G03G 5/085; G03G 5/14

[52] U.S. Cl. ..... 430/132; 430/55; 430/94; 430/127; 430/133

[58] Field of Search ..... 430/132, 133, 127, 55, 430/67, 69, 94, 96, 130

[56] References Cited

U.S. PATENT DOCUMENTS

| | | | |
|---|---|---|---|
| 3,241,958 | 3/1966 | Bernarth et al. | 430/60 |
| 3,447,957 | 6/1969 | Behringer | 430/127 |
| 3,464,820 | 9/1969 | Michalchik | 430/60 |
| 3,494,789 | 2/1970 | Makino et al. | 346/135.1 |
| 3,585,027 | 6/1971 | Shimizu | 430/87 |
| 3,595,649 | 7/1971 | Shimizu et al. | 430/60 |
| 3,595,650 | 7/1971 | Helzinger et al. | 430/69 |
| 3,637,433 | 1/1972 | Sims | 430/130 |
| 3,672,889 | 6/1972 | Baltazzi et al. | 430/87 |
| 3,704,122 | 11/1972 | Yamaguchi et al. | 430/96 |
| 3,756,812 | 9/1973 | Krohn et al. | 430/40 |
| 3,756,843 | 9/1973 | Honjo et al. | 430/96 |
| 3,787,208 | 1/1974 | Jones | 430/87 |
| 3,801,317 | 4/1974 | Tawaka et al. | 430/57 |
| 3,849,128 | 11/1974 | Ihara | 430/132 |
| 3,874,942 | 4/1975 | Negishi et al. | 430/67 |

*Primary Examiner*—Dennis E. Talbert, Jr.
*Assistant Examiner*—John L. Goodrow
*Attorney, Agent, or Firm*—Fitzpatrick, Cella, Harper & Scinto

[57] ABSTRACT

An electrophotographic photosensitive member is prepared by dispersing photoconductive particle in a binder resin in a solvent and forming a photoconductive film by removing the solvent. Transition temperature of the binder resin and the preparation temperature are to be selected in such a way that the balance between these temperatures is within a certain range.

2 Claims, 10 Drawing Figures

PROCESS FOR PRODUCING ELECTROPHOTOGRAPHIC PHOTOSENSITIVE MEMBER

This is a continuation, of application Ser. No. 666,780, now abandoned filed Mar. 15, 1976, which, in turn, is a continuation of Application Ser. No. 354,509, filed Apr. 25, 1973 now abandoned.

BACKGROUND OF THE INVENTION

1. Field of the Invention

This invention relates to a process for preparing an electrophotographic photosensitive member, and more particularly to a process for producing a photoconductive layer from a mixture system of photoconductive particle and a binder resin.

2. Description of the Prior Art

In general, a photosensitive member for electrophotography comprises a base and a photoconductive layer overlying the base, or if desired, additionally an insulating layer overlying the photoconductive layer. The structure of the photosensitive member is dependent upon the electrophotographic system.

A representative electrophotographic process using a photosensitive member having a photoconductive layer overyling a base is so-called Electrofax system which comprises applying a positive or negative voltage to a surface of the photoconductive layer, subjecting to imagewise exposure by radiation energy to form electrostatic latent images on the surface of the photoconductive layer, and developing the latent image in the dark by a dry or wet development to reproduce the images.

Another representative electrophotographic process using a photosensitive member having an insulating layer on a photoconductive layer is a process as disclosed in U.S. Pat. No. 3,666,363 and U.S. Pat. No. 3,438,706 which comprises applying a primary voltage of a certain polarity to an insulating layer of the photosensitive member, applying or discharging a secondary voltage of a polarity opposite to that of the primary charge simultaneously with imagewise exposure by radiation energy, if desired, additionally applying a blanket radiation to produce electrostatic latent images on the surface of the insulating layer, and developing the latent images by dry or wet development to reproduce the image.

Other than the above mentioned electrophotographic processes, there are proposed various electrophotographic processes which fundamental principle using the photoconductive layer is almost the same as that of the above mentioned electrophotographic processes.

The photoconductive layer may be composed of a photoconductor alone or a mixture of photoconductive particle and a binder resin. Examples of the former are alloys containing Se, Se-Te or Se-Ge-Si, vapor deposited CdS and organic semiconductors. The latter may be produced by dispersing crystal particles of $Cu_2O$, CuI, ZnO, ZnS, ZnSe, CdS, Se-Te, CdSe, CdTe, PbS, $Sb_2S_2$, GeS, or GeSe in a binder resin such as thermosetting resins, for example, epoxy resin, and unsaturated polyester resin, and thermoplastic resins soluble in a solvent, for example, copolymer of vinyl chloride and vinyl acetate, polyvinyl chloride, polyvinyl acetate, cellulose acetate, nitrocellulose, acryl resin, methacryl resin, phenolic resin, polyvinyl alcohol, and polyvinyl butyral and forming a photosensitive layer therefrom.

The present invention is relevant to the latter, that is, photoconductor particle dispersed in a binder resin.

In general, the amount of the binder resin in such photoconductive layer is preferably not higher than 50% based on the photoconductor particle since the amount of the binder resin exceeding 50% results in high electric resistance, lowering the characteristics, and difficult formation of the image. Therefore, heretofore there has been prepared a paint containing far more photoconductor particle than a binder resin, diluted with a solvent to a viscosity suitable for coating, applied to a support and dried (cured).

Photoconductive layer of an electrophotographic photosensitive member should have good charge retaining property, low dark decay, high conductivity when irradiated and high sensitivity. Further, a binder resin should have the following characteristics. (1) When photoconductor particle is dispersed in the binder resin, the resulting surface is free from irregularity and smooth. (2) The resulting photoconductive layer is free from void and has uniform density. (3) The binder resin can highly disperse the photoconductor particle and shows high adsorption property for the photoconductor particle.

The above-mentioned characteristics affect image quality such as electrostatic contrast, resolving power and the like to a great extent.

According to conventional processes for producing a photoconductive layer as mentioned above, there are selected a binder resin, a diluent and photoconductor particle taking into consideration chemical composition, molecular weight, and viscosity. Furthermore, the coating method and the manufacturing temperature have been improved based on experience to satisfy the above mentioned characteristics. However, the conditions can not be determined on the basis of the same rule. In other words, even when the best dispersion and uniformity can be obtained by selecting particular chemical composition and molecular weight, the resulting photoconductive layer is not always excellent as a photosensitive member for electrophotography. On the contrary, even when the charge retaining property and sensitivity are excellent, sometimes there occurs irregularity of charge and lowering of conductivity upon irradiated. Therefore, it is very difficult to find definite conditions capable of always producing a good photoconductive layer. It is very significant to find such a condition capable of giving always a good photoconductive layer.

The present inventors have now found that there is a certain important condition for obtaining such good photoconductive layer which is closely related to adsorption property between a binder resin and a photoconductor particle. The present invention has been accomplished based on this discovery.

SUMMARY OF THE INVENTION

According to an aspect of the present invention, there is provided a process for preparing an electrophotographic photosensitive member comprising dispersing photoconductor particle in a binder resin in a solvent and forming a photoconductive film by removing the solvent, in which the binder resin has a glass transition temperature ranging from a temperature lower than a preparation temperature by 35° C. to a temperature higher than a preparing temperature by 40° C. and a volume resistivity not lower than $10^{11}$ ohm.cm. The binder resin may be produced by mixing two or more different resins.

According to another aspect of the present invention, there is provided a process for preparing an electrophotographic photosensitive member comprising dispersing photoconductive particle in a binder resin in a solvent and forming a photoconductive film by removing the solvent, in which a preparation temperature ranging from a temperature lower than the glass transition temperature of the binder resin by 40° C. to a temperature higher than the glass transition temperature of the binder resin by 35° C., and volume resistivity of the binder resin is not lower than $10^{11}$ ohm.cm.

An object of this invention is to provide a condition for selecting a binder resin in a photoconductive layer.

Another object of this invention is to provide a photoconductive layer by using the binder resin thus selected.

A further object of this invention is to provide stably a photosensitive member for electrophotography employing the photoconductive layer.

PREFERRED EMBODIMENT OF THE INVENTION

By "glass transition temperature" (hereinafter called "Tg") is meant a temperature at which a polymer material changes from a glassy hard state to a rubber state upon heating. This temperature is a particular temperature for a polymer having a sufficiently high molecular weight.

The measured results of the Examples 1–10 (infra) are represented in the graphs of FIGS. 1–4.

Figure 1:
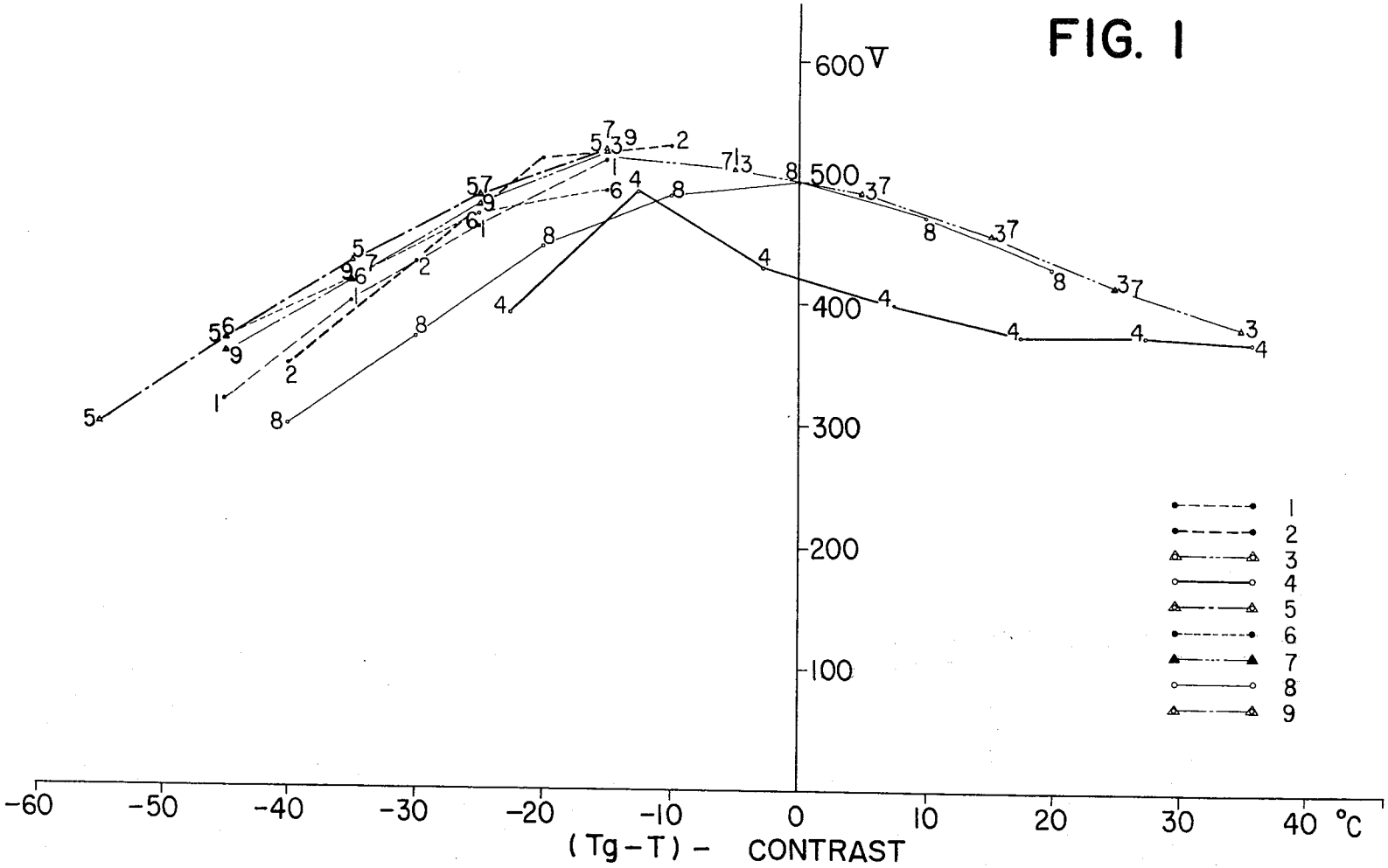
FIGS. 1–4 are graphs showing measured values of electrostatic contrast, surface potential and sensitivity by using a photoconductive layer according to this invention.

FIG. 1 is a graph representing values of electrostatic contrast of a photosensitive member having an insulating layer on the photoconductive layer when the electrophotographic process of U.S. Pat. No. 3,666,363 is employed.

Figure 2:
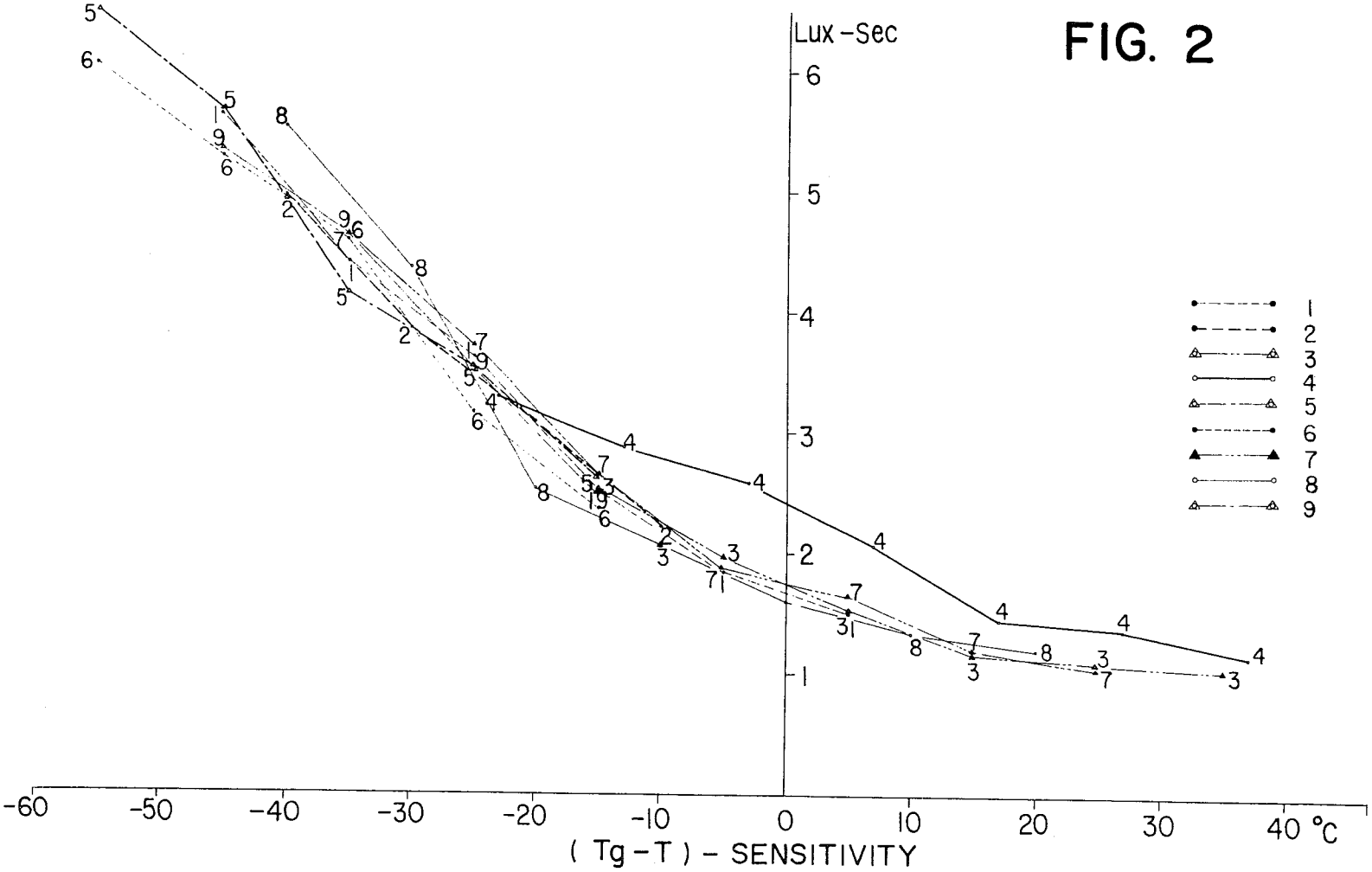

FIG. 2 is a graph showing values of sensitivity in the same manner as mentioned above.

Figure 3:
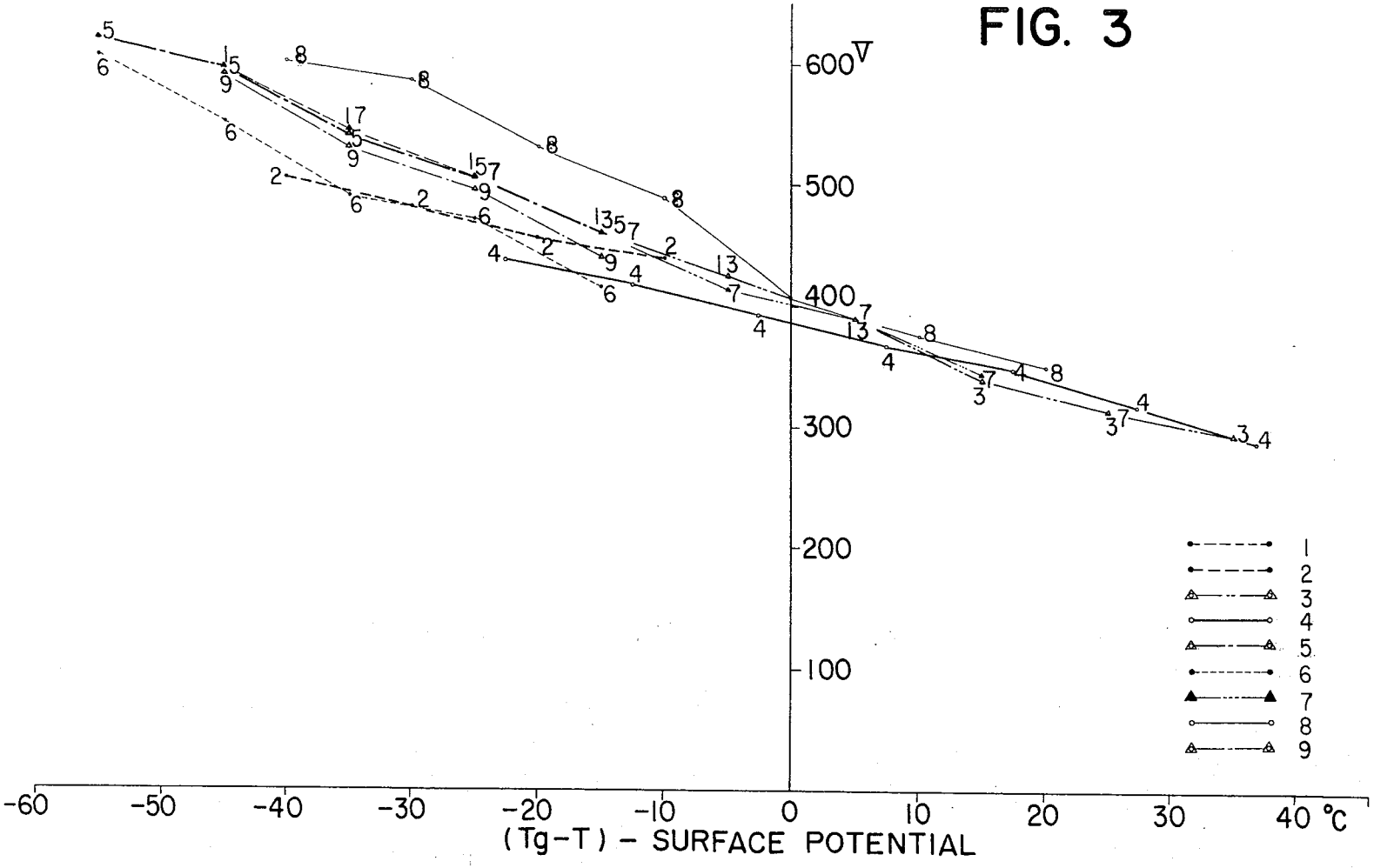
Figure 4:
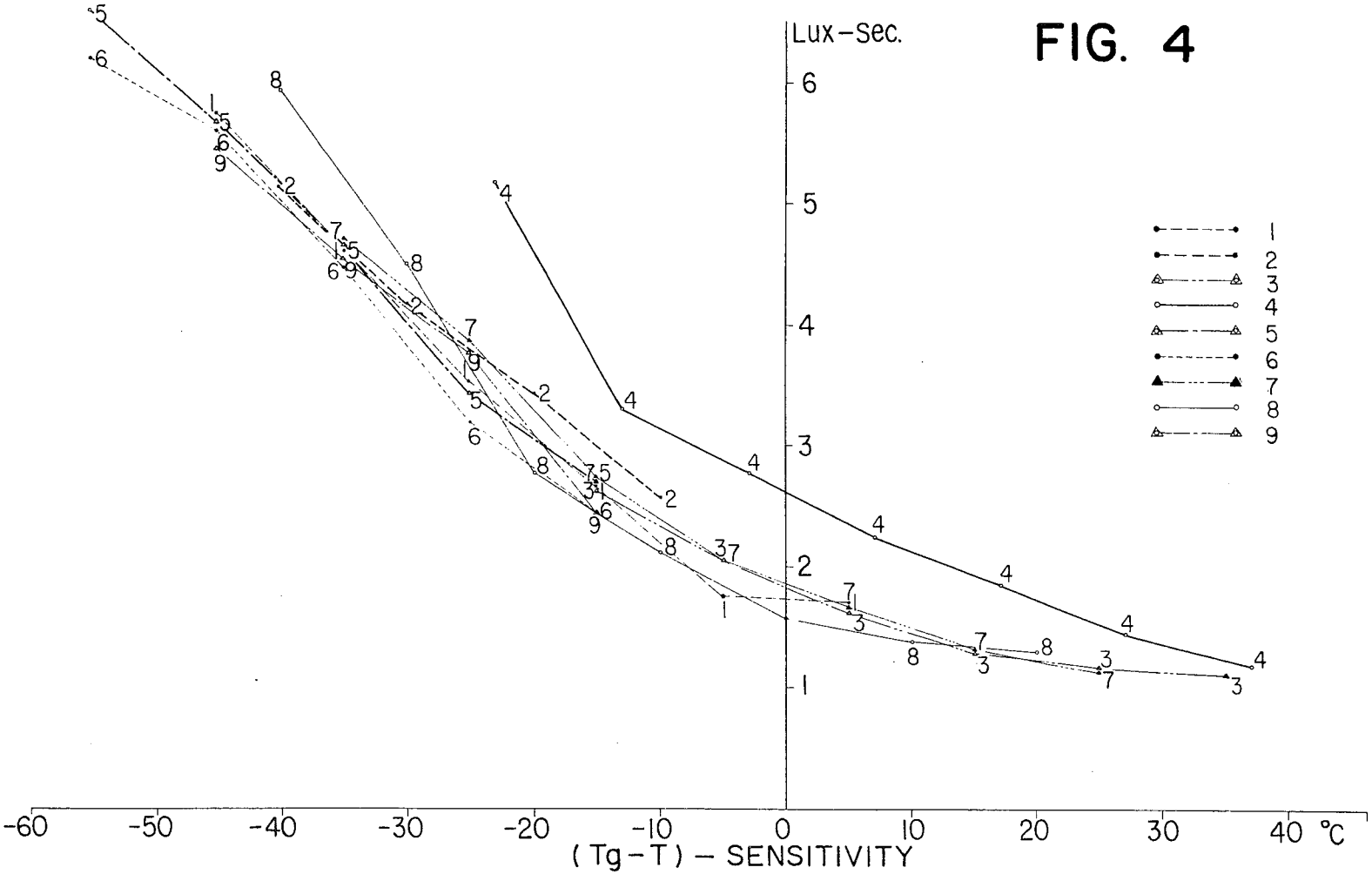
Figure 5:
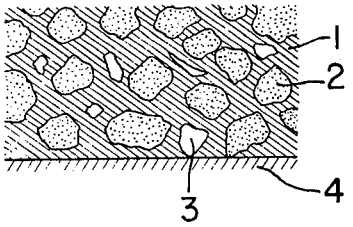
FIGS. 5–7 show the distribution state of photoconductor particle and binder resin.

FIGS. 3 and 4 are graphs showing values of surface potential and sensitivity when each photoconductive layer is subjected to DC corona charge. However, the sensitivity illustrated in FIG. 4 is measured with respect to Electrofax system.

In these graphs, each numeral on the curve shows corresponding to numbers of each Example. Each abscissa represents the balance (hereinafter called "Tg-T") between Tg (glass transition temperature) of the binder resin used and T of a preparation temperature of a photoconductive layer, while each ordinate represents voltage (V) in case of electrostatic contrast and surface potential, and Lux.Sec. in case of sensitivity.

From these graphs, it is evident that the contrast is the maximum in case that Tg of a binder resin is in the neighborhood of a preparation temperature and the greater the (Tg-T) is, the smaller the electrostatic contrast is in FIG. 1.

In the electrophotographic system, when a photosensitive member exhibiting such property as shown in FIG. 1 is employed, the desirable electrostatic contrast required for forming image is regarded as being more than about 350 V, in view of this point it is necessary that the value of (Tg-T) ranges from −35° C. to +40° C.

In FIG. 2 representing the measured results of sensitivity, it is recognized that as the value of (Tg-T) decreases, the sensitivity becomes worse. The value of the sensitivity usually required is less than about 4.5 Lux.-Sec., and therefore, it is necessary that the value of (Tg-T) is more than about −35° C.

FIG. 3 represents the measured results of surface potential and FIG. 4 represents the sensitivity. In either case, it is readily understood that if the value of (Tg-T) is more than about −35° C., the photosensitive member exhibits the desirable state.

In view of the foregoing, it is understood that the range of (Tg-T) in which electrostatic contrast, surface potential and sensitivity are in a desirable range is from −35° C. to +40° C. Further details are shown below.

When the binder resin having Tg lower than a preparation temperature of a photoconductive layer is employed, as the value of (Tg-T) decreases, the surface potential increases while the sensitivity become worse. Seemingly the reason for this tendency is that the adsorption of binder resin 1 to the surface of photoconductor particle 2 is excellent so that each particle is enveloped perfectly. On the other hand, the electric resistance of a photoconductive layer itself becomes higher since distance between photoconductor particles is too broad.

Figure 6:
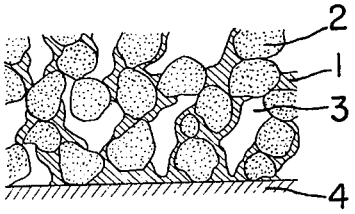
Figure 7:
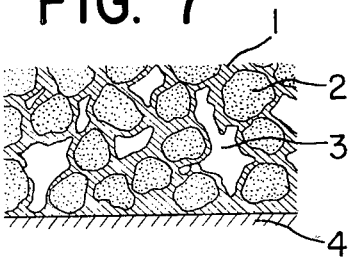

Such distribution state of photoconductor particle in a photoconductive layer was identified with a scanning type electron microscope. When a binder resin having Tg higher than a temperature for preparing a photoconductive layer is employed, the distribution of photoconductor particle is as shown in FIG. 6. That is, in the adsorption of binder resin 1 to the surface of photoconductor particle 2, the adsorption point thereof is few on account of greater rigidity of binder molecule. Even if the binding is excellent, enveloping the surface of photoconductor particle is not so perfect that many parts in which the connection between photoconductor particles is excellent are formed, and gap 3 is very large. Therefore, the contrast and surface potential show a tendency to decrease, and further the sensitivity shows a tendency to be excessively high.

In this case, however, by raising a preparation temperature and accelerating the motion of the molecules, it is possible to improve the property of a photosensitive member.

Figure 11:
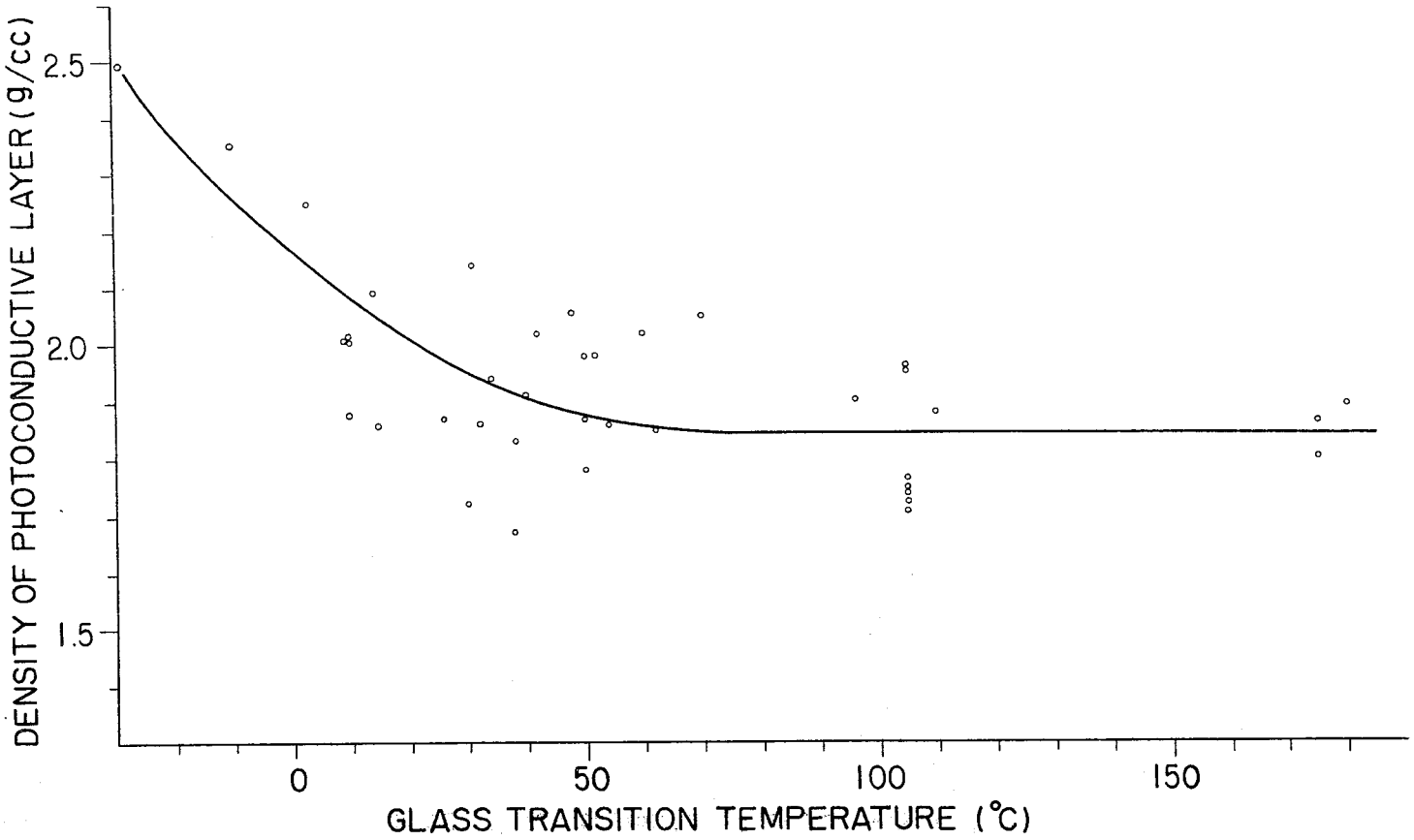

When the solvent having a lower boiling point is used, practically it is necessary to select a diluting solvent for raising the boiling point since the vaporizing state of the solvent affects the formation of a photoconductive layer to a great extent. Accordingly, the most desirable distribution state of photoconductor particle in the photoconductive layer is that the adsorption state of the photoconductor particle is appropriate and some gap is present and further the distance between photoconductor particles is appropriably near. Such state may be attained when the value of Tg-T is from −35° C. to +40° C. as aforementioned and as shown in Examples 1–10 illustrating the property curve. The above mentioned factors are clearly relevant to the relation between the density of photoconductive layer and Tg. The relation between Tg of a binder resin and the density of the photoconductive layer at a preparation temperature of 25° C. is shown in FIG. 11.

Furthermore, it is possible to attain the excellent state as mentioned above by the mixture of the resins having lower Tg and higher Tg.

In case of copolymer, the glass transition temperature, Tg of a mixture of the resins having a lower glass transition temperature, Tg(1) and a higher glass transition temperature, Tg(2) is represented by the following equation:

$$\frac{1}{Tg} = \frac{\text{Weight of the resin having } Tg(1)}{Tg(1)} + \frac{\text{Weight of the resin having } Tg(2)}{Tg(2)}$$

Accordingly, a temperature of Tg may be easily controlled by the equation, and thus the desirable photoconductive layer can be obtained by controlling Tg to the above mentioned range.

It is well known that Tg may be controlled by a plasticizer.

As mentioned above, it is necessary that the temperature of (Tg-T) is the range from −35° C. to +40° C. In case of conventional preparations of a photosensitive member for electrophotography, the best way is to carry out the preparation at a normal temperature or a neighborhood thereof. Therefore, a binder resin having Tg ranging from −10° C. to +65° C. is desirable on the assumption that a normal temperature is 25° C. In general, when there is selected a binder resin having Tg not lower than the preparation temperature by 35° C. and not higher than the preparation temperature by 40° C., an excellent photoconductive layer may be obtained. As an example, when binder resins having various Tg are used and the preparation temperature of a photoconductive layer is 25° C. and 35° C., the measured results of the surface potential, electrostatic contrast and sensitivity of a photoconductive layer thus prepared are shown in FIGS. 8–10.

By "preparation temperature" of a photoconductive layer in this invention is meant a preparation temperature of a paint, a coating temperature and a temperature of the set to touch.

Figure 8A:
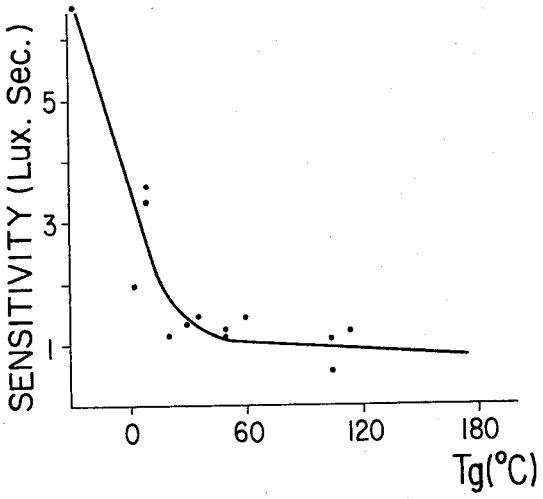
FIGS. 8–10 are graphs showing measured values of electrostatic contrast, surface potential and sensitivity when resins having various glass transition temperatures are used.
Figure 8B:
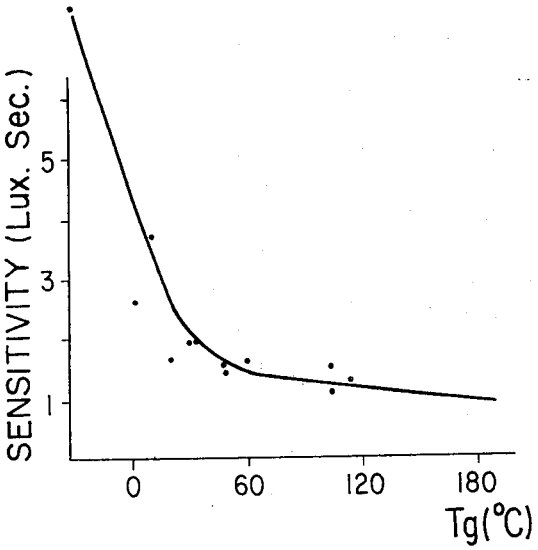

When a photosensitive member having an insulating layer on a photoconductive layer is produced and the sensitivity thereof is measured, the measured results are shown in FIG. 8 in which "(A)" represents a case in which the preparation temperature of photoconductive layer is 25° C., and "(B)" represents a case in which that temperature is 35° C.

Figure 9A:
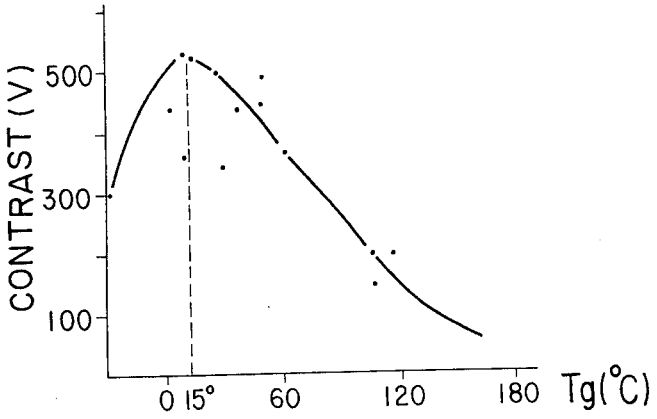
Figure 9B:
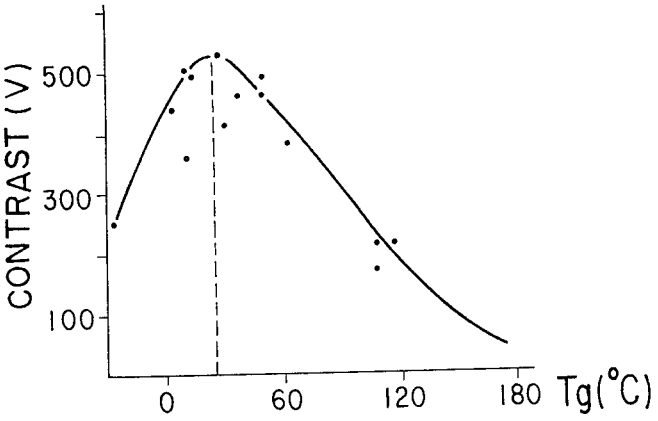
Figure 10A:
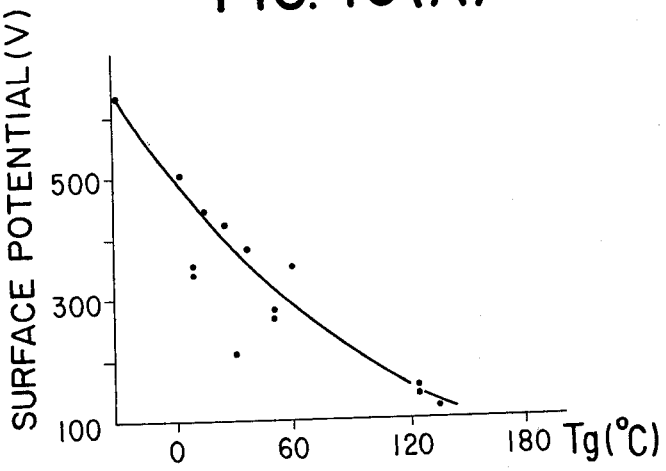
Figure 10B:
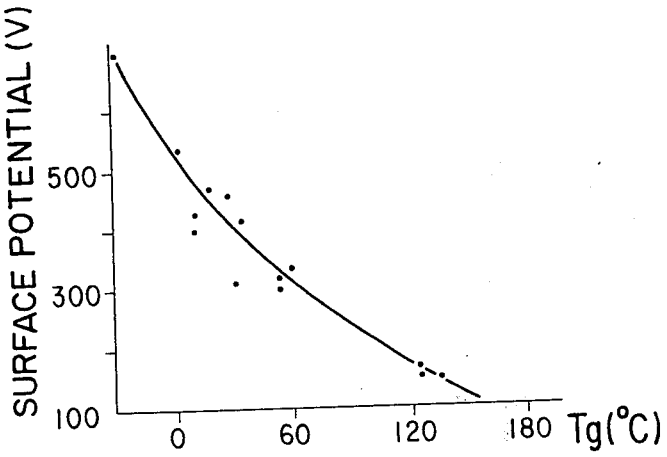

FIG. 9 shows the measured results of electrostatic contrast in a similar photosensitive member to that in FIG. 8 and the both "(A)" and "(B)" represent the same as the case of FIG. 8.

The measured results of the surface potential, when the photoconductive layer is subjected to voltage of D.C., are shown in FIG. 10 in which "(A)" represents a case of preparing photoconductive layer at 25° C. and "(B)" represents a case at 35° C.

From the above described results, it is readily understood that the excellent results are obtained in case of using a binder resin having Tg not lower than the preparation temperature by 35° C. and not higher than the preparation temperature by 40° C.

When a photoconductive layer is prepared as mentioned above, the relation between a preparation temperature and a glass transition temperature of a binder resin has been studied on the basis of powder of cadmium sulfide, furthermore the case of using a polyester film as an insulating layer has been investigated in this specification. However, this invention is by no means restricted to those materials as mentioned above and in the Examples (infra), but there may be used effectively a photoconductor particle series such as ZnCdS, $Cd_4SiS_6$ and the like other than CdS and other materials as photoconductor particle. Further the resin as mentioned above can be used as an insulating layer. A binder resin is selected in accordance with the above mentioned requirement. If volume resistivity of the binder resin is low, the binder resin can not hold the charge. Accordingly, the volume resistivity of the binder resin itself is required at least about $10^{11}$ ohm.cm.

Electrostatic contrast, surface potential and sensitivity of a photoconductive layer prepared from polymer materials having various Tg are shown in Examples (infra).

In the Examples there are shown surface potential and sensitivity measured when AC 5 KV is charged for 5 seconds on a photoconductive layer, and electrostatic contrast and sensitivity measured when there is used an electrophotographic process of U.S. Pat. No. 3,666,363 comprising applying a primary voltage of +7 KV, applying a secondary voltage of AC 6 KV simultaneously with irradiating with a radiation energy and applying a blanket irradiation at 1200 lux.sec.

The thickness of the photoconductive layer is 30–40 microns and the insulating layer is a polyester film of 25–30 microns thick.

EXAMPLE 1

Acryl resin having a glass transition temperature (Tg) of 30° C., sold under the trademark Dianal LR-472 by Mitsubishi Rayon Co., Ltd. and powder of cadmium sulfide were mixed at a ratio of 1:5 (by weight) and dispersed to prepare a paint by using toluol, xylol and Solvesso 150 (trade name, manufactured by Esso Co. Ltd.) as a diluting solvent under preparation conditions at a temperature not higher than 35° C., 45°–55° C. and at a temperature not lower than 65° C., respectively. The paint prepared under the above mentioned conditions was coated on the surface of an aluminum foil base with a knife coater under six preparation conditions of (1) 25° C., (2) 35° C., (3) 45° C., (4) 55° C., (5) 65° C. and (6) 75° C. in the thickness of 10–200 microns and the resulting paint-coating was allowed to stand under a windless state until the set to touch was attained. After the residual solvent in the photoconductive layer thus obtained was perfectly removed, a polyester film of 10–100 microns in thickness was adhered to the photoconductive layer with an adhesive to produce a photosensitive member having an insulating layer. On the other hand, the above mentioned photoconductive layer was directly used as a photosensitive member when an insulating layer is unnecessary.

Electrophotographic system of U.S. Pat. No. 3,666,363

| Preparation conditions | Electrostatic contrast (V) | sensitivity (Lux.sec.) | Quality of image | Formed state |
|---|---|---|---|---|
| 1 | 480 | 1.52 | | |
| 2 | 510 | 1.85 | | |
| 3 | 520 | 2.50 | | |

-continued

| | | | | |
|---|---|---|---|---|
| 4 | 465 | 3.64 | | |
| 5 | 400 | 4.43 | | Δ |
| 6 | 320 | 5.68 | Δ | Δ |

Electrofax system

| Preparation conditions | Surface potential (V) | Sensitivity (Lux.sec.) | Quality of image | Formed state |
|---|---|---|---|---|
| 1 | 390 | 1.68 | | |
| 2 | 425 | 1.75 | | |
| 3 | 460 | 2.66 | | |
| 4 | 505 | 3.52 | | |
| 5 | 545 | 4.61 | Δ | Δ |
| 6 | 595 | 5.74 | × | Δ |

EXAMPLE 2

Acrylated urethane resin, having a Tg of about 15° C. sold under the trademark Acrydic A805 by Dainippon Ink Co., Ltd. and powder of cadmium sulfide were mixed at a ratio of 3:10 (by weight) and dispersed to prepare a paint by using toluol and xylol as a diluting solvent under preparation conditions at a temperature lower than 35° C. and at a temperature higher than 35° C., respectively. The paint thus prepared was coated on the surface of an aluminum foil base with a knife coater under four preparation conditions of (1) 25° C., (2) 35° C., (3) 45° C. and (4) 55° in the thickness of 10–200 microns and the resulting paint-coating was allowed to stand under a windless state until the set to touch was attained. After the residual solvent in the photoconductive layer thus obtained was perfectly removed, the photoconductive layer was bonded with a polyester film of 10–100 microns in thickness with an adhesive to produce a photosensitive member having an insulating layer, while the above mentioned photoconductive layer was directly used as a photosensitive member when an insulating layer is unnecessary.

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 530 | 2.23 | | |
| 2 | 520 | 3.19 | | |
| 3 | 435 | 3.86 | Δ | |
| 4 | 350 | 4.98 | Δ | |

Electrofax system

| Preparation conditions | Surface potential (V) | Sensitivity (Lux.sec.) | Quality of image | Formed state |
|---|---|---|---|---|
| 1 | 440 | 2.56 | | |
| 2 | 455 | 3.42 | | |
| 3 | 480 | 4.15 | Δ | |
| 4 | 505 | 5.13 | Δ | |

EXAMPLE 3

Vinyl chloride special copolymer resin having a Tg of 60° C., sold under the trademark Geon 400 X A by Nippon Geon Co., Ltd. and powder of cadmium sulfide were mixed at a ratio of 1:10 (by weight) and dispersed to prepare a paint by using the mixed solvent of MEK and toluol (1:1, by weight), the mixed solvent of MIBK and xylol (1:1, by weight) and the mixed solvent of cyclohexanone and Solvesso 150 (1:1, by weight) as a diluting solvent under preparation conditions of at a temperature not higher than 35° C., 45°–55° C. and at a temperature not lower than 65° C., respectively. The paint prepared under the above mentioned conditions was coated on the surface of an aluminum foil base with a knife coater under six preparation conditions of (1) 25° C., (2) 35° C., (3) 45° C., (4) 55° C., (5) 65° C. and (6) 75° C. in the thickness of 10–200 microns and the resulting paint-coating was allowed to stand under a windless state until the set to touch was attained. After the residual solvent in the photoconductive layer thus obtained was perfectly removed, the photoconductive layer was bonded with a polyester film of 10–100 microns in thickness with an adhesive to produce a photosensitive member having an insulating layer. On the contrary, the above mentioned photoconductive layer was directly used as a photosensitive member when an insulating layer is unnecessary.

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 380 | 1.05 | Δ | |
| 2 | 415 | 1.13 | | |
| 3 | 455 | 1.26 | | |
| 4 | 490 | 1.51 | | |
| 5 | 510 | 1.96 | | |
| 6 | 525 | 2.54 | | |

Electrofax system

| Preparation conditions | Surface potential (V) | Sensitivity (Lux.sec.) | Quality of image | Formed state |
|---|---|---|---|---|
| 1 | 295 | 1.12 | Δ | |
| 2 | 315 | 1.16 | | |
| 3 | 340 | 1.30 | | |
| 4 | 390 | 1.62 | | |
| 5 | 425 | 2.05 | | |
| 6 | 460 | 2.63 | | |

EXAMPLE 4

Thermoplastic resin, having a Tg of 62° C., sold under the trademark Hitaloid 1105 by Hitachi Kasei Co., Ltd. and powder of cadmium sulfide were mixed at a ratio of 3:20 (by weight) and dispersed to prepare a paint by using toluol, xylol and Solvesso 150 as a diluting solvent under preparation conditions at a temperature not higher than 35° C., 45°–55° C. and at a temperature not lower than 65° C., respectively. The paint thus prepared under the above mentioned conditions was coated on the surface of an aluminum foil base with a knife coater under seven preparation conditions of (1) 25° C., (2) 35° C., (3) 45° C., (4) 55° C., (5) 65° C., (6) 75° C. and (7)85° C. in the thickness of 20–200 microns. The resulting paint-coating was allowed to stand under a windless state until the set to touch was attained. After the residual solvent in the photoconductive layer thus obtained was perfectly removed, the photoconductive layer was bonded with a polyester film of 10–100 microns in thickness with an adhesive to produce a photosensitive member having an insulating layer. On the other hand, the above mentioned photoconductive layer was directly used as a photosensitive member when an insulating layer is unnecessary.

Electrophotographic system of U.S. Pat. No. 3,666,363

Electro-

-continued

| Preparation conditions | static contrast (V) | Sensitivity (Lux.sec.) | Quality of image | Formed state |
|---|---|---|---|---|
| 1 | 370 | 1.16 | Δ | |
| 2 | 375 | 1.38 | Δ | |
| 3 | 375 | 1.45 | | |
| 4 | 400 | 2.06 | | |
| 5 | 435 | 2.57 | | |
| 6 | 490 | 2.89 | | |
| 7 | 590 | 3.30 | | Δ |

Electrofax system

| Preparation conditions | Surface potential (V) | Sensitivity (Lux.sec.) | Quality of image | Formed state |
|---|---|---|---|---|
| 1 | 290 | 1.20 | Δ | |
| 2 | 320 | 1.46 | | |
| 3 | 350 | 1.86 | | |
| 4 | 370 | 2.25 | | |
| 5 | 395 | 2.79 | | |
| 6 | 420 | 3.30 | | |
| 7 | 440 | 5.18 | | |

EXAMPLE 5

Polyester resin, having a Tg of 10° C., sold under the trademark Ester Resin 30 by Toyobo Vylon Co., Ltd. and powder of cadmium sulfide were mixed at a ratio of 1:5 (by weight) and dispersed to prepare a paint by using the mixed solvent of toluol and MEK (4:1, by weight), the mixed solvent of xylol and MIBK (4:1, by weight) and the mixed solvent of Solvesso 150 and cyclohexanone (4:1, by weight) as a diluting solvent under preparation conditions at a temperature not higher than 25° C., 35°-45° C., and at a temperature not lower than 55° C., respectively. The paint thus prepared under the above mentioned conditions was coated on the surface of an aluminum foil base with a knife coater under five preparation conditions of (1) 25° C., (2) 35° C., (3) 45° C., (4) 55° C. and (5) 65° C. in the thickness of 10-200 microns. The resulting paint-coating was allowed to stand under a windless state until the set to touch was attained. And then the residual solvent in the photoconductive layer thus obtained was perfectly removed. The resulting photoconductive layer was bonded with a polyester film of 10-100 microns in thickness with an adhesive to produce a photosensitive member having an insulating layer. On the contrary, the above mentioned photoconductive layer was directly used as a photosensitive member when an insulating layer is unnecessary.

Electrophotographic system of U.S. Pat. No. 3,666,363

| Preparation conditions | Electro static contrast (V) | Sensitivity (Lux.sec.) | Quality of image | Formed state |
|---|---|---|---|---|
| 1 | 525 | 2.62 | | |
| 2 | 400 | 3.54 | | |
| 3 | 435 | 4.65 | | |
| 4 | 365 | 5.71 | | |
| 5 | 295 | 6.50 | Δ | |

Electrofax system

| Preparation conditions | Surface potential (V) | Sensitivity (Lux.sec.) | Quality of image | Formed state |
|---|---|---|---|---|
| 1 | 460 | 2.70 | | |
| 2 | 503 | 3.44 | | |
| 3 | 540 | 4.65 | | |

-continued

| | | | | |
|---|---|---|---|---|
| 4 | 595 | 5.68 | Δ | |
| 5 | 620 | 6.61 | Δ | |

EXAMPLE 6

Acrylated urethane resin, having a Tg of about 10° C., sold under the trademark Acrydic A 804 by Dainippon Ink Co., Ltd. and powder of cadmium sulfide were mixed at a ratio of 1:5 (by weight) and dispersed to prepare a paint by using toluol, xylol and Solvesso 150 as a diluting solvent under preparation conditions at a temperature not higher than 35° C., 45°-55° C. and at a temperature not lower than 65° C., respectively. The paint prepared under the above mentioned conditions was coated on the surface of an aluminum foil base with a knife coater under five preparation conditions of (1) 25° C., (2) 35° C., (3) 45° C., (4) 55° C. and (5) 65° C. in the thickness of 10-200 microns. The resulting paint-coating was allowed to stand under a windless state until the set to touch was attained. After the residual solvent in the photoconductive layer thus obtained was perfectly removed, the photoconductive layer was bonded with a polyester film of b 10-100 microns in thickness with an adhesive to produce a photosensitive member having an insulating layer. On the contrary, the above mentioned photoconductive layer was directly used as a photosensitive member when an insulating layer is unnecessary.

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 490 | 2.38 | | |
| 2 | 470 | 3.16 | | |
| 3 | 420 | 4.60 | | |
| 4 | 370 | 5.33 | Δ | |
| 5 | 300 | 6.05 | Δ | |

Electrofax system

| Preparation conditions | Surface potential (V) | Sensitivity (Lux.sec.) | Quality of image | Formed state |
|---|---|---|---|---|
| 1 | 415 | 2.45 | | |
| 2 | 470 | 3.20 | | |
| 3 | 490 | 4.48 | | |
| 4 | 550 | 5.61 | Δ | |
| 5 | 605 | 6.20 | Δ | |

EXAMPLE 7

Thermoplastic acryl resin, having a Tg of 50° C., sold uner the trademark Dianal Br-105 by Mitsubishi Rayon Co., Ltd. and powder of cadmium sulfide were mixed at a ratio of 1:5 (by weight) and dispersed to prepare a paint by using toluol, xylol and Solvesso 150 as a diluting solvent under preparation conditions at a temperature not higher than 35° C., 45°-55° C. and at a temperature not lower than 65° C., respectively. The paint thus prepared under the above mentioned conditions was coated on the surface of an aluminum foil base with a knife coater under seven preparation conditions of (1) 25° C., (2) 35° C., (3) 45° C., (4) 55° C., (5) 65° C., (6) 75° C., and (7) 85° C. in the thickness of 10-200 microns. The resulting paint-coating was allowed to stand under a windless state until the set to touch was attained. After the residual solvent in the photoconductive layer thus obtained was perfectly removed, the photoconductive layer was bonded with a polyester film of 10–100 microns in thickness with an adhesive to produce a photosensitive member having an insulating layer. On the other hand, the photoconductive layer was directly used as a photosensitive member when an insulating layer is unnecessary.

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 415 | 1.10 | Δ | |
| 2 | 455 | 1.21 | | |
| 3 | 490 | 1.65 | | |
| 4 | 510 | 1.89 | | |
| 5 | 530 | 2.65 | | |
| 6 | 485 | 3.73 | | |
| 7 | 420 | 4.62 | | Δ |

Electrofax system

| Preparation conditions | Surface potential (V) | Sensitivity (Lux.sec.) | Quality of image | Formed state |
|---|---|---|---|---|
| 1 | 315 | 1.15 | Δ | |
| 2 | 345 | 1.31 | | |
| 3 | 390 | 1.70 | | |
| 4 | 415 | 2.05 | | |
| 5 | 400 | 2.72 | | |
| 6 | 500 | 3.86 | | |
| 7 | 545 | 4.71 | | Δ |

EXAMPLE 8

Polyimide resin, having a Tg of 45° C., sold under the trademark Hitamide 502X by Hitachi Kasei Co., Ltd. and powder of cadmium sulfide were mixed at a ratio of 3:10 (by weight) and dispersed to prepare a paint by using the mixed solvent of isopropyl alcohol and toluene (1:1, by weight), the mixed solvent of butanol and MIBK (1:1, by weight) and the mixed solvent of butanol and Solvesso 150 (1:1, by weight) as a diluting solvent under preparation conditions at a temperature not higher than 35° C., 45°–55° C. and at a temperature not lower than 65° C., respectively. The paint prepared under the above mentioned conditions was coated on the surface of an aluminum foil base with a knife coater under seven preparation conditions of (1) 25° C., (2) 35° C., (3) 45° C., (4) 55° C., (5) 65° C., (6) 75° C. and (7) 85° C. in the thickness of 10–200 microns. The resulting paint-coating was allowed to stand under a windless state until the set to touch was attained, and then the residual solvent in the photoconductive layer thus obtained was perfectly removed. The photoconductive layer was bonded with a polyester film of 10–100 microns in thickness with an adhesive to produce a photosensitive member having an insulating layer. On the contrary, the photoconductive layer was directly used as a photosensitive member when an insulating layer is unnecessary.

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 430 | 1.20 | | |
| 2 | 470 | 1.33 | | |
| 3 | 500 | 1.60 | | |
| 4 | 490 | 2.06 | | |
| 5 | 450 | 2.55 | | |
| 6 | 370 | 4.38 | | |
| 7 | 300 | 5.54 | Δ | Δ |

Electrofax system

| Preparation conditions | Surface potential (V) | Sensitivity (Lux.sec.) | Quality of image | Formed state |
|---|---|---|---|---|
| 1 | 350 | 1.30 | | |
| 2 | 375 | 1.39 | | |
| 3 | 405 | 1.58 | | |
| 4 | 490 | 2.11 | | |
| 5 | 530 | 2.78 | | |
| 6 | 585 | 4.50 | | |
| 7 | 600 | 5.93 | Δ | Δ |

EXAMPLE 9

Ethylene-vinyl acetate copolymer resin having a Tg of 10° C., sold under the trademark Soarlex S by Nippon Gosei Co., Ltd. and powder of cadmium sulfide were mixed at a ratio of 3:10 (by weight) and dispersed to prepare a paint by using methyl alcohol, ethyl alcohol and propyl alcohol as a diluting solvent under preparation conditions at a temperature of 25° C., 35°–45° C. and 55° C., respectively. The paint thus prepared under the above mentioned conditions was coated on the surface of an alminum foil base with a knife coater under four preparation conditions of (1) 25° C., (2) 35° C., (3) 45° C. and (4) 55° C. in the thickness of 10–200 microns. The resulting paint-coating was allowed to stand under a windless state until the set to touch was attained, and then the residual solvent in the photoconductive layer obtained was perfectly removed. The photoconductive layer was bonded with a polyester film of 10–100 microns in thickness with an adhesive to produce a photosensitive member having an insulating layer. On the other hand, the above mentioned photoconductive layer was directly used as a photosensitive member when an insulating layer is unnecessary.

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 510 | 2.50 | | |
| 2 | 480 | 3.52 | | |
| 3 | 420 | 4.61 | Δ | |
| 4 | 360 | 5.33 | Δ | |

Electrofax system

| Preparation conditions | Surface potential (V) | Sensitivity (Lux.sec.) | Quality of image | Formed state |
|---|---|---|---|---|
| 1 | 440 | 2.44 | | |
| 2 | 495 | 3.76 | | |
| 3 | 530 | 4.53 | Δ | |
| 4 | 590 | 5.45 | Δ | |

Modified xylene resin having a Tg of 115° C., sold under the trademark by Nikanol S-100 by Mitsubishi Gas Kagaku Co., Ltd. and powder of cadmium sulfide were mixed at a ratio of 1:5 (by weight) and dispersed to prepare a paint by using toluol and xylol as a diluting solvent under preparation conditions at a temperature not higher than 35° C. and at a temperature not lower than 35° C., respectively. The paint thus prepared under the above mentioned conditions was coated on the surface of an aluminum foil base with a knife coater under five preparation conditions of (1) 25° C., (2) 35° C., (3) 45° C., (4) 55° C. and (5) 65° C. in the thickness of 10–200 microns. The resulting paint-coating was allowed to stand under a windless state until the set to touch was attained, and then the residual solvent in the photoconductive layer thus obtained was perfectly removed. The photoconductive layer was bonded with a polyester film of 10–100 microns in thickness with an adhesive to produce a photosensitive member having an insulating layer. On the other hand, the above mentioned photoconductive layer was directly used as a photosensitive member when an insulating layer is unnecessary.

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 180 | 0.86 | × | Δ |
| 2 | 200 | 0.89 | × | Δ |
| 3 | 210 | 0.96 | × | Δ |
| 4 | 225 | 1.05 | × | Δ |
| 5 | 260 | 1.11 | × | |

Electrofax system

| Preparation conditions | Surface potential (V) | Sensitivity (Lux.sec.) | Quality of image | Formed state |
|---|---|---|---|---|
| 1 | 50 | 0.89 | × | Δ |
| 2 | 45 | 0.89 | × | Δ |
| 3 | 40 | 0.93 | × | Δ |
| 4 | 45 | 1.00 | × | Δ |
| 5 | 45 | 1.15 | × | |

We claim:

1. Process for preparing an electrophotographic photosensitive member for use in an electrophotographic process which includes applying a primary voltage of a certain polarity to an insulating layer of the photosensitive member, applying or discharging a secondary voltage of a polarity opposite to that of the primary charge simultaneously with imagewise exposure by radiation energy and applying a blanket radiation to produce electrostatic latent images on the surface of the insulating layer, comprising the steps of (a) coating a dispersion of photoconductive CdS particles in a resin binder dissolved in a solvent for the resin binder onto a substrate, (b) removing the solvent thereby forming a photoconductive film composed of said photoconductive particles dispersed in said resin binder, (c) forming an insulating layer on the photoconductive film, wherein said resin binder has a glass transition temperature Tg and (d) conducting said steps (a) and (b) at a temperature T wherein the value (Tg-T) is from (−35° C.) to (+40° C.) and wherein said resin binder has a volume resistivity of not lower than $10^{11}$ ohm.cm.

2. Process according to claim 1 in which at least two different binder resins are mixed to produce the binder resin having a glass transition temperature ranging from a temperature lower than a preparation temperature by 35° C. to a temperature higher than a preparing temperature by 40° C. and a volume resistivity not lower than $10^{11}$ ohm.cm.

* * * * *

UNITED STATES PATENT AND TRADEMARK OFFICE

CERTIFICATE OF CORRECTION

PATENT NO. : 4,252,883

DATED : February 24, 1981

INVENTOR(S) : NOBORU KOMURA, ET AL.

It is certified that error appears in the above-identified patent and that said Letters Patent are hereby corrected as shown below:

Column 7, line 27, after "(4)" change 55° to -- 55° C --.
Column 8, line 54, after "thickness of" change 20-200 to -- 10-200 --.
Column 10, line 25, after "film of" delete -- b --.

Column 6, lines 61-68 over to Column 7, lines 1-14;

"

Electrophotographic system of U.S. Pat. No. 3,666,363

| Preparation conditions | Electrostatic contrast (V) | Sensitivity (Lux·sec.) | Quality of image | Formed state |
|---|---|---|---|---|
| 1 | 480 | 1.52 | | |
| 2 | 510 | 1.85 | | |
| 3 | 520 | 2.50 | | |
| 4 | 465 | 3.64 | | |
| 5 | 400 | 4.43 | | Δ |
| 6 | 320 | 5.68 | Δ | Δ |

Electrofax system

| Preparation conditions | Surface potential (V) | Sensitivity (Lux·sec.) | Quality of image | Formed state |
|---|---|---|---|---|
| 1 | 390 | 1.68 | | |
| 2 | 425 | 1.75 | | |
| 3 | 460 | 2.66 | | |
| 4 | 505 | 3.52 | | |
| 5 | 545 | 4.61 | Δ | Δ |
| 6 | 595 | 5.74 | × | Δ |

"

should be --

Electrophotographic system of U.S.P. 3,666,363

| Preparation conditions | Electrostatic contrast (V) | Sensitivity (Lux·sec.) | Quality of image | Formed state |
|---|---|---|---|---|
| 1 | 480 | 1.52 | ○ | ○ |
| 2 | 510 | 1.85 | ○ | ○ |
| 3 | 520 | 2.50 | ○ | ○ |
| 4 | 465 | 3.64 | ○ | ○ |
| 5 | 400 | 4.43 | ○ | Δ |
| 6 | 320 | 5.68 | Δ | Δ |

Electrofax system

| Preparation conditions | Surface potential (V) | Sensitivity (Lux·sec.) | Quality of image | Formed state |
|---|---|---|---|---|
| 1 | 390 | 1.68 | ○ | ○ |
| 2 | 425 | 1.75 | ○ | ○ |
| 3 | 460 | 2.66 | ○ | ○ |
| 4 | 505 | 3.52 | ○ | ○ |
| 5 | 545 | 4.61 | Δ | Δ |
| 6 | 595 | 5.74 | × | Δ |

--

UNITED STATES PATENT AND TRADEMARK OFFICE

CERTIFICATE OF CORRECTION

PATENT NO. : 4,252,883

DATED : February 24, 1981

INVENTOR(S) : NOBORU KOMURA, ET AL.

It is certified that error appears in the above-identified patent and that said Letters Patent are hereby corrected as shown below:

Column 7, lines 39-55;

"

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 530 | 2.23 | | |
| 2 | 520 | 3.19 | | |
| 3 | 435 | 3.86 | Δ | |
| 4 | 350 | 4.98 | Δ | |

Electrofax system

| Preparation conditions | Surface potential (V) | Sensitivity (Lux.sec.) | Quality of image | Formed state |
|---|---|---|---|---|
| 1 | 440 | 2.56 | | |
| 2 | 455 | 3.42 | | |
| 3 | 480 | 4.15 | Δ | |
| 4 | 505 | 5.13 | Δ | |

"

should be --

Electrophotographic system of U.S.P. 3,666,363

| Preparation conditions | Electrostatic contrast (V) | Sensitivity (Lux-sec.) | Quality of image | Formed state |
|---|---|---|---|---|
| 1 | 530 | 2.23 | O | O |
| 2 | 520 | 3.19 | O | O |
| 3 | 435 | 3.86 | Δ | O |
| 4 | 350 | 4.98 | Δ | O |

Electrofax system

| Preparation conditions | Surface potential (V) | Sensitivity (Lux-sec.) | Quality of image | Formed state |
|---|---|---|---|---|
| 1 | 440 | 2.56 | O | O |
| 2 | 455 | 3.42 | O | O |
| 3 | 480 | 4.15 | Δ | O |
| 4 | 505 | 5.13 | Δ | O |

--

Column 8, lines 18-37;

"

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 380 | 1.05 | Δ | |
| 2 | 415 | 1.13 | | |
| 3 | 455 | 1.26 | | |
| 4 | 490 | 1.51 | | |
| 5 | 510 | 1.96 | | |
| 6 | 525 | 2.54 | | |

Electrofax system

| Preparation conditions | Surface potential (V) | Sensitivity (Lux.sec.) | Quality of image | Formed state |
|---|---|---|---|---|
| 1 | 295 | 1.12 | Δ | |
| 2 | 315 | 1.16 | | |
| 3 | 340 | 1.30 | | |
| 4 | 390 | 1.62 | | |
| 5 | 425 | 2.05 | | |
| 6 | 460 | 2.63 | | |

"

should be --

Electrophotographic system of U.S.P. 3,666,363

| Preparation conditions | Electrostatic contrast (V) | Sensitivity (Lux-sec.) | Quality of image | Formed state |
|---|---|---|---|---|
| 1 | 380 | 1.05 | Δ | O |
| 2 | 415 | 1.13 | O | O |
| 3 | 455 | 1.26 | O | O |
| 4 | 490 | 1.51 | O | O |
| 5 | 510 | 1.96 | O | O |
| 6 | 525 | 2.54 | O | O |

Electrofax system

| Preparation conditions | Surface potential (V) | Sensitivity (Lux-sec.) | Quality of image | Formed state |
|---|---|---|---|---|
| 1 | 295 | 1.12 | Δ | O |
| 2 | 315 | 1.16 | O | O |
| 3 | 340 | 1.30 | O | O |
| 4 | 390 | 1.62 | O | O |
| 5 | 425 | 2.05 | O | O |
| 6 | 460 | 2.63 | O | O |

--

UNITED STATES PATENT AND TRADEMARK OFFICE
CERTIFICATE OF CORRECTION

PATENT NO. : 4,252,883

DATED : February 24, 1981

INVENTOR(S) : NOBORU KOMURA, ET AL.

It is certified that error appears in the above-identified patent and that said Letters Patent are hereby corrected as shown below:

Column 8, lines 66-68 over to Column 9, lines 1-21;

"

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 370 | 1.16 | Δ | |
| 2 | 375 | 1.38 | Δ | |
| 3 | 375 | 1.45 | | |
| 4 | 400 | 2.06 | | |
| 5 | 435 | 2.57 | | |
| 6 | 490 | 2.89 | | |
| 7 | 590 | 3.30 | | Δ |

Electrofax system

| Preparation conditions | Surface potential (V) | Sensitivity (Lux.sec.) | Quality of image | Formed state |
|---|---|---|---|---|
| 1 | 290 | 1.20 | Δ | |
| 2 | 320 | 1.46 | | |
| 3 | 350 | 1.86 | | |
| 4 | 370 | 2.25 | | |
| 5 | 395 | 2.79 | | |
| 6 | 420 | 3.30 | | |
| 7 | 440 | 5.18 | | |

"

should be --

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 370 | 1.16 | Δ | O |
| 2 | 375 | 1.38 | Δ | O |
| 3 | 375 | 1.45 | O | O |
| 4 | 400 | 2.06 | O | O |
| 5 | 435 | 2.57 | O | O |
| 6 | 490 | 2.89 | O | O |
| 7 | 590 | 3.30 | O | Δ |

Electrofax system

| Preparation conditions | Surface potential (V) | Sensitivity (Lux.sec.) | Quality of image | Formed state |
|---|---|---|---|---|
| 1 | 290 | 1.20 | Δ | O |
| 2 | 320 | 1.46 | O | O |
| 3 | 350 | 1.86 | O | O |
| 4 | 370 | 2.25 | O | O |
| 5 | 395 | 2.79 | O | O |
| 6 | 420 | 3.30 | O | O |
| 7 | 440 | 5.18 | O | O |

--

Column 9, lines 52-68 over to Column 10, lines 1-4;

"

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 525 | 2.62 | | |
| 2 | 400 | 3.54 | | |
| 3 | 435 | 4.65 | | |
| 4 | 365 | 5.71 | | |
| 5 | 295 | 6.50 | Δ | |

Electrofax system

| Preparation conditions | Surface potential (V) | Sensitivity (Lux.sec.) | Quality of image | Formed state |
|---|---|---|---|---|
| 1 | 460 | 2.70 | | |
| 2 | 503 | 3.44 | | |
| 3 | 540 | 4.65 | | |
| 4 | 595 | 5.68 | Δ | |
| 5 | 620 | 6.61 | Δ | |

"

should be --

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 525 | 2.62 | O | O |
| 2 | 490 | 3.54 | O | O |
| 3 | 435 | 4.65 | O | O |
| 4 | 365 | 5.71 | O | O |
| 5 | 295 | 6.50 | Δ | O |

Electrofax system

| Preparation conditions | Surface potential (V) | Sensitivity (Lux.sec.) | Quality of image | Formed state |
|---|---|---|---|---|
| 1 | 460 | 2.70 | O | O |
| 2 | 503 | 3.44 | O | O |
| 3 | 540 | 4.65 | O | O |
| 4 | 595 | 5.68 | Δ | O |
| 5 | 620 | 6.61 | Δ | O |

--

UNITED STATES PATENT AND TRADEMARK OFFICE

CERTIFICATE OF CORRECTION

PATENT NO. : 4,252,883

DATED : February 24, 1981

INVENTOR(S) : NOBORU KOMURA, ET AL.

It is certified that error appears in the above-identified patent and that said Letters Patent are hereby corrected as shown below:

Column 10, lines 32-50;

"

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 490 | 2.38 | | |
| 2 | 470 | 3.16 | | |
| 3 | 420 | 4.60 | | |
| 4 | 370 | 5.33 | Δ | |
| 5 | 300 | 6.05 | Δ | |

Electrofax system

| Preparation conditions | Surface potential (V) | Sensitivity (Lux.sec.) | Quality of image | Formed state |
|---|---|---|---|---|
| 1 | 415 | 2.45 | | |
| 2 | 470 | 3.20 | | |
| 3 | 490 | 4.48 | | |
| 4 | 550 | 5.61 | Δ | |
| 5 | 605 | 6.20 | Δ | |

"

should be --

Electrophotographic system of U.S. Pat. 3,666,363

| Preparation conditions | Electrostatic contrast (V) | Sensitivity (Lux.sec.) | Quality of image | Formed state |
|---|---|---|---|---|
| 1 | 490 | 2.33 | O | O |
| 2 | 470 | 3.16 | O | O |
| 3 | 420 | 4.60 | O | O |
| 4 | 370 | 5.33 | Δ | O |
| 5 | 300 | 6.05 | Δ | O |

Electrofax system

| Preparation conditions | Surface potential (V) | Sensitivity (Lux.sec.) | Quality of image | Formed state |
|---|---|---|---|---|
| 1 | 415 | 2.45 | O | O |
| 2 | 470 | 3.20 | O | O |
| 3 | 490 | 4.48 | O | O |
| 4 | 550 | 5.61 | Δ | O |
| 5 | 605 | 6.20 | Δ | O |

--

Column 11, lines 10-31;

"

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 415 | 1.10 | Δ | |
| 2 | 455 | 1.21 | | |
| 3 | 490 | 1.65 | | |
| 4 | 510 | 1.89 | | |
| 5 | 530 | 2.65 | | |
| 6 | 485 | 3.73 | | |
| 7 | 420 | 4.62 | | Δ |

Electrofax system

| Preparation conditions | Surface potential (V) | Sensitivity (Lux.sec.) | Quality of image | Formed state |
|---|---|---|---|---|
| 1 | 315 | 1.15 | Δ | |
| 2 | 345 | 1.31 | | |
| 3 | 390 | 1.70 | | |
| 4 | 415 | 2.05 | | |
| 5 | 400 | 2.72 | | |
| 6 | 500 | 3.86 | | |
| 7 | 545 | 4.71 | | Δ |

"

should be --

Electrophotographic system of U.S.P. 3,666,363

| Preparation conditions | Electrostatic contrast (V) | Sensitivity (Lux.sec.) | Quality of image | Formed state |
|---|---|---|---|---|
| 1 | 415 | 1.10 | Δ | O |
| 2 | 455 | 1.21 | O | O |
| 3 | 490 | 1.65 | O | O |
| 4 | 510 | 1.89 | O | O |
| 5 | 530 | 2.65 | O | O |
| 6 | 485 | 3.73 | O | O |
| 7 | 420 | 4.62 | O | Δ |

Electrofax system

| Preparation conditions | Surface potential (V) | Sensitivity (Lux.sec.) | Quality of image | Formed state |
|---|---|---|---|---|
| 1 | 315 | 1.15 | Δ | O |
| 2 | 345 | 1.31 | O | O |
| 3 | 390 | 1.70 | O | O |
| 4 | 415 | 2.05 | O | O |
| 5 | 400 | 2.72 | O | O |
| 6 | 500 | 3.86 | O | O |
| 7 | 545 | 4.71 | O | Δ |

--

UNITED STATES PATENT AND TRADEMARK OFFICE
CERTIFICATE OF CORRECTION

PATENT NO. : 4,252,883

DATED : February 24, 1981

INVENTOR(S) : NOBORU KOMURA, ET AL.

It is certified that error appears in the above-identified patent and that said Letters Patent are hereby corrected as shown below:

Column 11, lines 62-68, over to Column 12, lines 1-17;

"

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 430 | 1.20 | | |
| 2 | 470 | 1.33 | | |
| 3 | 500 | 1.60 | | |
| 4 | 490 | 2.06 | | |
| 5 | 450 | 2.55 | | |
| 6 | 370 | 4.38 | | |
| 7 | 300 | 5.54 | Δ | Δ |

Electrofax system

| Preparation conditions | Surface potenual (V) | Sensitivity (Lux.sec.) | Quality of image | Formed state |
|---|---|---|---|---|
| 1 | 350 | 1.30 | | |
| 2 | 375 | 1.39 | | |
| 3 | 405 | 1.58 | | |
| 4 | 490 | 2.11 | | |
| 5 | 530 | 2.78 | | |
| 6 | 585 | 4.50 | | |
| 7 | 600 | 5.93 | Δ | Δ |

"

should be --

Electrophotographic system of U.S.P. 3,666,363

| Preparation conditions | Electrostatic contrast (V) | Sensitivity (Lux.sec.) | Quality of image | Formed state |
|---|---|---|---|---|
| 1 | 430 | 1.20 | ○ | ○ |
| 2 | 470 | 1.33 | ○ | ○ |
| 3 | 500 | 1.60 | ○ | ○ |
| 4 | 490 | 2.06 | ○ | ○ |
| 5 | 450 | 2.55 | ○ | ○ |
| 6 | 370 | 4.38 | ○ | ○ |
| 7 | 300 | 5.54 | Δ | Δ |

Electrofax system

| Preparation conditions | Surface potential (V) | Sensitivity (Lux.sec.) | Quality of image | Formed state |
|---|---|---|---|---|
| 1 | 350 | 1.30 | ○ | ○ |
| 2 | 375 | 1.39 | ○ | ○ |
| 3 | 405 | 1.58 | ○ | ○ |
| 4 | 490 | 2.11 | ○ | ○ |
| 5 | 530 | 2.78 | ○ | ○ |
| 6 | 585 | 4.50 | ○ | ○ |
| 7 | 600 | 5.93 | Δ | Δ |

--

Column 12, lines 44-60;

"

Electrophotographic system of U.S. Pat. No. 3,666,363

| Preparation conditions | Electrostatic contrast (V) | Sensitivity (Lux.sec.) | Quality of image | Formed state |
|---|---|---|---|---|
| 1 | 510 | 2.50 | | |
| 2 | 480 | 3.32 | | |
| 3 | 420 | 4.61 | Δ | |
| 4 | 360 | 5.33 | Δ | |

Electrofax system

| Preparation conditions | Surface potential (V) | Sensitivity (Lux.sec.) | Quality of image | Formed state |
|---|---|---|---|---|
| 1 | 440 | 2.44 | | |
| 2 | 495 | 3.76 | | |
| 3 | 530 | 4.53 | Δ | |
| 4 | 590 | 5.45 | Δ | |

"

should be --

Electrophotographic system of U.S.P. 3,666,363

| Preparation conditions | Electrostatic contrast (V) | Sensitivity (Lux.sec.) | Quality of image | Formed state |
|---|---|---|---|---|
| 1 | 510 | 2.50 | ○ | ○ |
| 2 | 480 | 3.32 | ○ | ○ |
| 3 | 420 | 4.61 | Δ | ○ |
| 4 | 360 | 5.33 | Δ | ○ |

Electrofax system

| Preparation conditions | Surface potential (V) | Sensitivity (Lux.sec.) | Quality of image | Formed state |
|---|---|---|---|---|
| 1 | 440 | 2.44 | ○ | ○ |
| 2 | 495 | 3.76 | ○ | ○ |
| 3 | 530 | 4.53 | Δ | ○ |
| 4 | 590 | 5.45 | Δ | ○ |

--

UNITED STATES PATENT AND TRADEMARK OFFICE

CERTIFICATE OF CORRECTION

PATENT NO. : 4,252,883 Page 6 of 6

DATED : February 24, 1981

INVENTOR(S) : NOBORU KOMURA, ET AL.

It is certified that error appears in the above-identified patent and that said Letters Patent are hereby corrected as shown below:

Column 13, lines 19-35, over to Column 14, lines 1-4;

"

Electrophotographic system of U.S. Pat. No. 3,666,363

| Preparation conditions | Electrostatic contrast (V) | Sensitivity (Lux sec.) | Quality of image | Formed state |
|---|---|---|---|---|
| 1 | 180 | 0.86 | × | Δ |
| 2 | 200 | 0.89 | × | Δ |
| 3 | 210 | 0.96 | × | Δ |
| 4 | 225 | 1.05 | × | Δ |
| 5 | 260 | 1.11 | × | |

Electrofax system

| Preparation conditions | Surface potential (V) | Sensitivity (Lux.sec.) | Quality of image | Formed state |
|---|---|---|---|---|
| 1 | 50 | 0.89 | × | Δ |
| 2 | 45 | 0.89 | × | Δ |
| 3 | 40 | 0.93 | × | Δ |
| 4 | 45 | 1.00 | × | Δ |
| 5 | 45 | 1.15 | × | |

"

should be --

Electrophotographic system of U.S.P. 3,666,363

| Preparation conditions | Electrostatic contrast (V) | Sensitivity (Lux.sec.) | Quality of image | Formed state |
|---|---|---|---|---|
| 1 | 180 | 0.86 | × | Δ |
| 2 | 200 | 0.89 | × | Δ |
| 3 | 210 | 0.96 | × | Δ |
| 4 | 225 | 1.05 | × | Δ |
| 5 | 260 | 1.11 | × | O |

Electrofax system

| Preparation conditions | Surface potential (V) | Sensitivity (Lux.sec.) | Quality of image | Formed state |
|---|---|---|---|---|
| 1 | 50 | 0.89 | × | Δ |
| 2 | 45 | 0.89 | × | Δ |
| 3 | 40 | 0.93 | × | Δ |
| 4 | 45 | 1.00 | × | Δ |
| 5 | 45 | 1.15 | × | O |

--

Signed and Sealed this

*Nineteenth* Day of *May 1981*

[SEAL]

*Attest:*

RENE D. TEGTMEYER

*Attesting Officer* *Acting Commissioner of Patents and Trademarks*